United States Patent [19]

Drogo

[11] Patent Number: 4,744,770

[45] Date of Patent: May 17, 1988

[54] MULTI-PIN ELECTRICAL CONNECTOR

[76] Inventor: Pierre L. M. Drogo, Le Verdier, Dampierre en Burly Ouzouer sur Loire (Loiret), France

[21] Appl. No.: 903,475

[22] Filed: Sep. 4, 1986

[30] Foreign Application Priority Data

Sep. 6, 1985 [FR] France ..... 85 13252

[51] Int. Cl.[4] ..... H01R 13/625

[52] U.S. Cl. ..... 439/318; 439/310

[58] Field of Search ..... 339/DIG. 2, 89 R, 89 L, 339/89 M, 90 R, 90 C; 439/312-323, 310

[56] References Cited

U.S. PATENT DOCUMENTS

| | | | |
|---|---|---|---|
| 4,506,943 | 3/1985 | Drogo | 339/DIG. 2 |
| 4,519,661 | 5/1985 | Brush, Sr. et al. | 339/89 M |
| 4,521,066 | 6/1985 | Kempe | 339/DIG. 2 |
| 4,530,559 | 7/1985 | Burns et al. | 339/90 R |
| 4,547,032 | 10/1985 | Burns et al. | 339/DIG. 2 |
| 4,629,272 | 12/1986 | Mattingly et al. | 339/90 R |

*Primary Examiner*—John McQuade

*Attorney, Agent, or Firm*—Clifford A. Poff

[57] ABSTRACT

Multi-pin electrical connector comprising a socket (1) and a plug (2), composed of a socket body (4) and a plug body (7), a ring (3) mounted to rotate on the plug body (7) and locking means for angularly positioning the ring in relation to the plug, in the position in which the ring is farthest forward in relation to the end of the plug, said connector being characterized in that the locking means (17) is disposed between the ring (3) and the plug body (7) and is designed so that it can be unlocked by an axial displacement command and in that the socket body (4) is assembled outside the plug body (7) and is housed between the ring (3) and the plug body (7), the length of the socket body (4) being such that upon assembly of the connector, it acts on the locking means (17) in order to unlock it.

8 Claims, 3 Drawing Sheets

MULTI-PIN ELECTRICAL CONNECTOR

Figure 1:
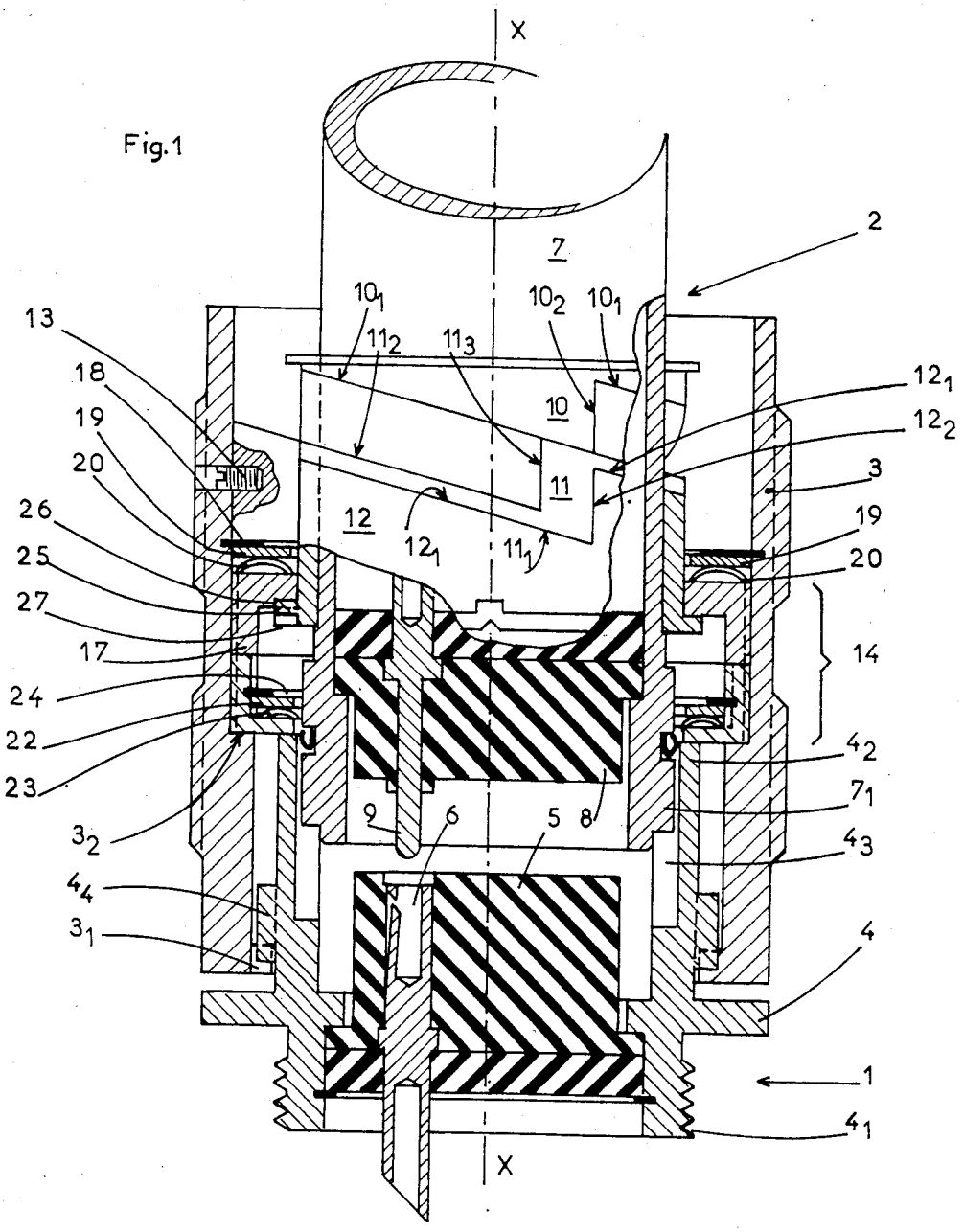

The invention relates to a multi-pin electrical connector.

Already known are electrical connectors which comprise a socket and a plug, each of which is composed of a socket body and a plug body inside which there is housed a block of insulating material comprising the male and female connecting pins.

A ring is mounted on the plug body by being screwthreaded or by means of cam slopes, so that rotation of the ring, engaged on ribs on the socket body simultaneously causes the plug body to move towards the socket body with maximum insertion of the male pins into the female pins.

In order to permit of this assembly, the male and female pins of course occupy precise radial and angular positions so that each male pin can be placed in the axis of its female pin, to the exclusion of any other position and, to this end, non-confusible grooves are provided between the socket body and the plug body.

However, in order to permit asembly of the plug on the socket of this connector, it is furthermore necessary for the ring to occupy a precise angular position in relation to the plug on the socket, the plug body is itself in a position of maximum withdrawal in relation to its ring for, if not, the ring would only be able to turn incompletely, which would give rise to an incomplete axial displacement of the plug body and therefore an incomplete insertion of the male pins into the female pins.

To avoid this drawback, there are provided on these known connectors elastically operating locking means consisting for instance of obliquely sided ribs, pushed by springs and assuming a position in correspondingly shaped housings. Therefore, these locking means create locally a "hard" point in the rotation of the ring, so that this ring is incapable of making a sudden turn on the plug body and so that it is possible therefore correctly to assemble the plug on the socket.

However, it did seem that certain makes of this type of connector might be regarded as defective because the 'hardness' offered by the locking means must result from a compromise between, on the one hand, the need to have maximum hardness to avoid with certainty rotation of the ring on the plug body and, on the other, the need for this hardness not to be too great, so that an operator can operate the connector in the normal way.

However, this compromise is difficult to achieve because the parts involved are of small size, and it is difficult to achieve uniformity of elastic locking force, the more so since this force must in any case be markedly greater than the friction forces resulting from rotation of the ring, so that the hard point of the ring locking action may be perceived manually by the sudden increase in the force needed to rotate the ring.

The object of the present invention is to remedy these drawbacks and, to this end, it relates to a multi-pin electrical connector comprising a socket and a plug, composed of a socket body and a plug body receiving blocks of insulating material, one provided with female pins, the other with male pins, a ring being mounted for rotation of the plug body through means which ensure its axial displacement of the plug body simultaneously with its rotary movement, this ring likewise comprising ribs which, by an axial displacement, are capable of engaging corresponding ribs provided on the socket body while permitting rotation of the ring on the socket body, locking means being furthermore provided for angularly positioning the ring in relation to the plug in the position for which the ring is most forward in relation to the end of the plug, said connector being characterized in that the locking means is disposed between the ring and the plug body and is designed so that it can be unlocked by an axial displacement control and in that the socket body is assembled outside the plug body and is housed between the ring and the socket body, the length of the socket body being such that, unpon assembly of the connector, what is important is the locking means, for the purpose of unlocking it.

According to another feature of the invention, the locking means comprises at least one rib having straight-sided flanks and at least one correspondingly shaped housing orientated axially on the plug, one provided on the plug body, the other on the ring, this rib or its housing being formed on an axially movable member.

According to another feature of the invention, the axially movable member comprises at one of its ends at least one rib having straight flanks or its housing and at its other end at least one rib having oblique flanks or its housing, the axial distance of the straight-flanked ribs and obliquely-flanked ribs and/or their housing corresponding to the relative axial travel of the plug body on the ring upon rotation of this latter.

Figure 2:
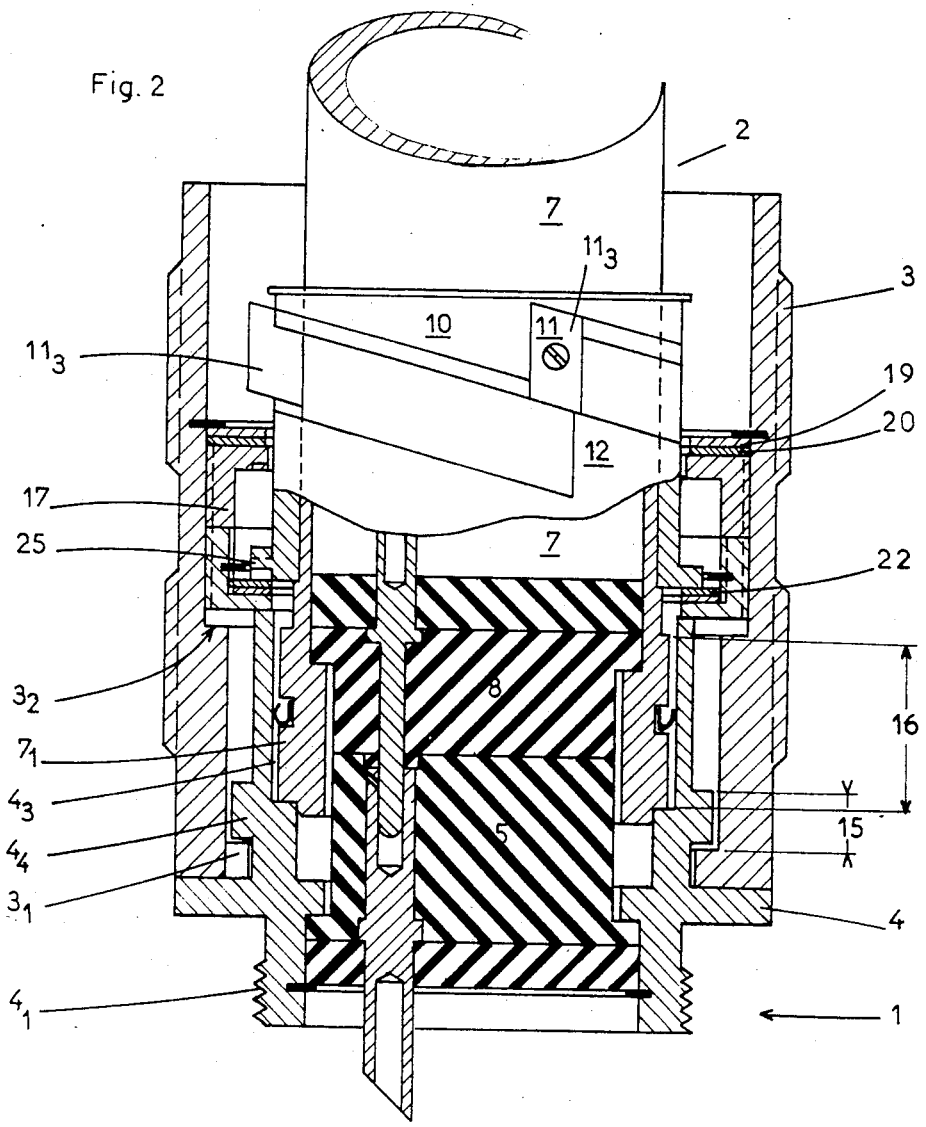
Figure 3:
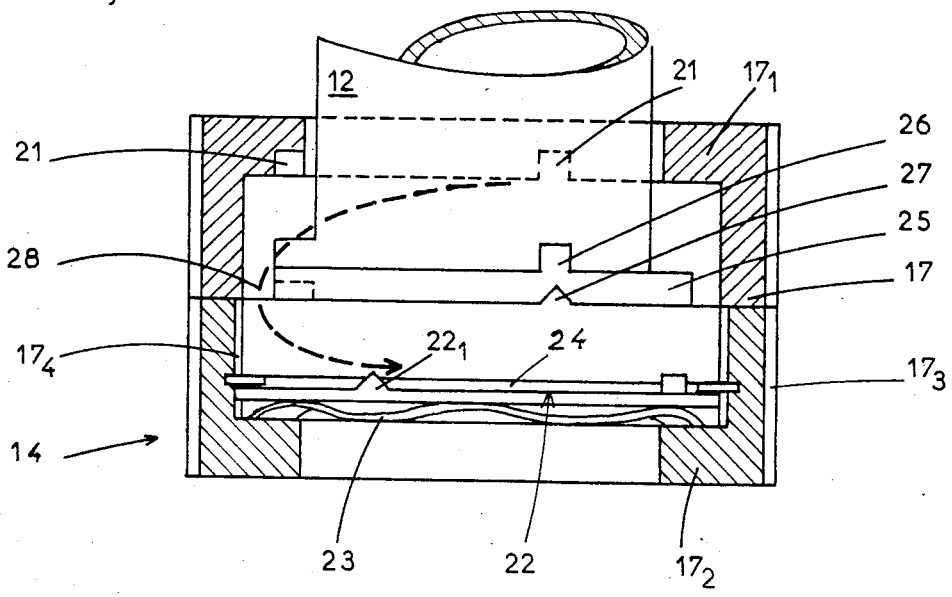

The invention is illustrated by way of non-limitative example in the appended drawings, in which:

FIG. 1 is an axial section with part broken away through an embodiment of the connector according to the invention, the plug and the scoket being shown in the position at commencement of assembly, FIG. 2 is a view corresponding to FIG. 1, the plug being assembled with its socket, FIG. 3 is an enlarged sectional view showing in particular the means of locking the ring on the plug body.

The object of the present invention is therefore to provide a multi-pin electrical connector of which the ring provided on the plug body cannot under any circumstance move angularly on the plug body save during the operation of assembly with the socket, to guarantee absolutely that the plug of the connector can in any case be assembled with its socket It is furthermore an object of the invention to provide this locking means so that outside the actual locking positions the locking means do not create any friction which might generate premature wear and tear or which might furthermore involve an increase in the force needed to operate the ring for the locking and unlocking operations.

It is likewise an object of the invention to dispense with the need to provide non-confusible means on the three essential parts of the connector, that is to say the plug body, the socket body and the ring, these non-confusible means being solely provided on the plug body and on the socket body, the ring itself only comprising ribs for attachment on the body of the socket. These ribs may therefore be standardised in order considerably to reduce the manufacturing costs and also the stocks of rings entailed by construction of the connector.

The connector shown in the appended drawings thus comprises a socket 1 and a plug 2, the latter having a locking ring 3.

The socket 1 comprises a metal socket body 4 provided with a screwthreading $4_1$ for fixing it on a support, said socket body 4 receiving a block of insulating material 5, preferably an elastomeric material, in which are housed the female connecting pins 6.

Similarly, the plug 2 consists of a metal plug body 7 receiving a block of insulating material 8 in which are housed the male pins 9. These male pins occupy a quite specific radial and angular position in the block 8 so that a female pin 6 corresponds to each of the male pins.

The ring 3 is connected to the plug body 7 through means ensuring its axial displacement on the plug body simultaneously with its rotary movement.

In the example illustrated, these means comprise three annular members 10, 11 and 12, the end members 10 and 12 being fixed to the plug body while the intermediate piece 11 is fixed by screws 13 to the inside wall of the ring 3.

The member 10 comprises on its underside three cam slopes $10_1$ each of which covers 120°, separated by abutment edges $10_2$. Similarly, the member 12 comprises on its upper edge three cam slopes $12_1$, each covering 120° and separated by abutment edges $12_2$ orientated parallel with the abutments $10_2$.

The intermediate annular member 11 fixed to the ring 3 has slopes $11_1$ and $11_2$ on its underside and its upper side respectively, these cam slopes each covering 120° and being separated by zones $11_3$ orientated parallel with the abutments $10_2$ and $12_2$. These zones project and receive the fixing screws 13 of the member 11, which attach it to the ring 3.

It will be readily appreciated that rotation of the ring is translated into a relative axial displacement of the ring on the plug body, the relative displacement of the ring and of the plug being a helical movement dependent on the angle of the cam slopes on the members 10, 11 and 12.

This manner of displacement of the ring on the plug body is known per se and is described simply by way of example. It could be replaced by any similar device producing an axial displacement of the plug body in relation to the ring upon rotation fo this latter.

According to the invention, a locking means 14 is provided between the ring and the plug body 7, this locking means being designed to be unlocked and to permit rotation of the ring on the plug body only when the plug is positioned on the socket in order to be unlocked.

It is likewise envisaged that the socket body 4 be seated on the outside of the plug body 7, that is to say between the plug body and the ring 3, this socket body 4 being of such a length that its upper end $4_2$ can, by a movement of relative axial displacement, actuate the locking means 14 and permit rotation of the ring and therefore the simultaneous movement of the plug body towards the socket body in order to insert the male pins 9 totally into the female pins 6.

According to the invention, it is likewise envisaged that the non-confusible keyways and ribs be provided on the one hand at $4_3$ on the inner wall of the socket body 4 and on the other at $7_1$ on the outer wall of the plug body 7, the ring 3 itself being provided solely with ribs for attachment $3_1$ situated close to its bottom end and intended to engage behind corresponding ribs $4_4$ provided on the outer face of the socket body 4.

These ribs $3_1$ and $4_4$ might well consist of uniform ribs, identical for all the rings of one and the same type of connector, in view of the fact that there sole function is to avoid confusion. This arrangement is of no interest with regard to the construction of the socket body 4, because anyway the socket bodies differ from one another in that they comprise non-confusible keyways $4_3$ but it is particularly interesting for the rings 3 which can therefore be identical to one another.

According to the invention, it is likewise envisaged that the ribs $3_1$ provided on the ring 3 and $4_4$ provided on the socket body 4 are, in the axial direction, of a height such that the non-confusible keyways and ribs $4_3$ and $7_1$ provided on the scoket body and on the plug body cooperate with one another before the ribs $3_1$ and $4_4$ penetrate one into the other. This arrangement is analysed in FIG. 2 by the fact that the assembly travel 15 of the ribs $3_1$ and $4_4$ situated at the base of the ring 3, is less than the assembly travel 16 of the non-confusible keyways and ribs $4_3$ and $7_1$ provided close to the top edge of the socket body 4 and the bottom edge of the plug body 7.

The locking means are shown in detail in FIG. 3.

These locking means comprise a cylindrical member 17 provided with inner returned edges $17_1$ and $17_2$ at its upper end lower ends, said member 17 being made in two parts for convenience of manufacture and assembly. The member 17 comprises ribs $17_3$ on its periphery, these ribs being housed in corresponding ribs on the inner face of the ring 3 to render them rotationally rigid while allowing them to move in an axial direction.

The member 17 has its bottom edge bearing on a shoulder $3_2$ on the ring while its upper edge bears on a sealing ring 18 through a washer 19 and an undulating spring 20.

The upper inner edge $17_1$ of the member 17 comprises crenellated notches 21 while the lower inner returned edge $17_2$ receives, bearing on its upper face, an annular member 22 provided on its upper face with projections of triangular cross-section $22_1$. This annular member 22 bears on a returned edge $17_2$ through an undulating annular spring 23, while it is retained on its upper face by a sealing ring 24 engaged in an annular groove in the member 17. The member 22 has on its periphery catches which engage corresponding grooves $17_4$ in the inner wall of the member 17 so that this member 22 is rotationally rigid in relation to the member 17 and therefore in relation to the ring 3, while permitting its axial displacement against the undulating spring 23.

The member 12 mounted on the plug body 7 has at its base an outer collar 25 having on its upper surface crenellated ribs 26 shaped to correspond to the crenellated notches 21 of the upper returned edge $17_1$.

Likewise, the underside of this collar 25 comprises notches 27 of triangular cross-section, the shape of which corresponds to that of the triangular projections $22_1$ on the member 22.

In the embodiment illustrated, these notches and projections 21 and 26 with straight sides or with sloping sides $22_1$ and 27 are three in number and are disposed at 120° from one another for reasons of stability of support of the member 17 during locking and unlocking operations. Furthermore, the axial distance between the notches 21 provided on the returned edge $17_1$ and the projections $22_1$ provided on the returned edge $17_2$ is such that it corresponds to the travel of the plug body 2 upon rotation of the ring 3, this distance being determined by the slope of the ramps on the members 10, 11 and 12.

In the same way, the angular offset of the straight-sided notches 21 and the oblique-sided projections $22_1$ is, taking into account the position of the projections and notches 26 and 27, determined in such a way that this angular offset corresponds to the maximum rotation of the ring 3, itself determined by the abutments $10_2$ and $12_2$ on the members 10 and 12, bearing in mind the width of the vertical projection $11_3$.

Thus, in the example illustrated, the connector is a quarter-of-a-turn connector and the ring 3 turns through 90° between the open and closed positions and the notches 21 are therefore offset by 90° in relation to the projections $22_1$.

This connector operates as follows:

When the socket is separated from the plug, the ring 3 is locked on the plug body 7 due to the fact that the ring is in its most forward or advanced position with regard to the plug body and because the straight-sided projections 26 are housed in the corresponding notches 21 on the top edge $17_1$ of the member 17.

When the socket is fitted onto the plug, the grooves $7_1$ on the plug cooperate with the grooves $4_3$ on the socket and therefore such fitment can be carried out only in one precise angular position, determined by the grooves $7_1$ and $4_3$, which angular position matches up each of the male pins 9 with its female pin 6.

By reason of the cooperation of the grooves $7_1$ and $4_3$, the plug is able to move in its axis X—X towards the socket so that the ribs $3_1$ on the locking ring 3 pass between the ribs $4_4$ on the socket 4 until the ribs $3_1$ are situated with their top edges beyond the bottom edges of the ribs $4_4$.

During this sliding of the ribs $3_1$ between the ribs $4_4$, the top end $4_2$ of the socket 4 acts on the bottom returned edge $17_2$ of the member 17 to maintain it in position while the ring 3 moves towards the socket 1, taking with it the intermediate member 11 and therefore the members 12 and 10 which are themselves fixed on the plug body 7. Upon axial movement of the ring 3 against the spring 20, the collar 25 performs an axial movement of the same amplitude so as to clear the ribs 26 from the notches 21 and unlock the ring from the plug body 7. The ring 3 can therefore turn in relation to the plug body 7, rotationally immobilized on the socket body 4, due to the fact that the ribs 3, are now situated beyond ribs 4.

When the ring 3 is rotated, it likewise rotates the intermediate annular member 11, of which the ramps $11_1$ cooperate with ramps $12_1$ on the member 12 so as to push said member axially back and the plug body 7 towards the socket 1. When the ring 3 performs its rotary movement through 90°, the member 12 and the ring 3 perform in relation to each other a helical movement represented by the arrow 28 in FIG. 3. This movement covers an angle of 90° and produces an axial displacement corresponding to the spacing apart of the notches 21 and projections $22_1$, so that the notches in the collar 25 are housed on the corresponding sloping-sided projections $22_1$ on the member 22.

It will be noted that during this relative helical movement there is no friction of the locking projections $22_1$ and 26 on the member 17, so that operation of the connector is facilitated and its reliability is enhanced, due to the reduction in wear and tear. It is only at the end of the assembly movement that the lower returned edge of the collar 25 bears on the projections $22_1$ against the undulating annular spring 23 until lthe projections $22_1$ are held resiliently in their notches 27.

At this stage, the plug of the connector is fully assembled with its socket (see FIG. 2), the pins 9 are introduced as far as they will go into the female pins 6 and the insulating block 8 of the plug is applied elastically against the insulating block 5 of the socket.

In this position of assembly, the ring is locked as regards rotation, due to the cooperation of the projections $22_1$ and notches 27, but this locking in the assembled position is not comparable with the locking in the disassembled position because a simple rotation of the ring 3 clears the projections $22_1$ from the notches 27 due to the elastic compression of the spring 23.

When the unlocking takes place, the 90° rotation of the ring 24 in the opposite direction causes an axial return of the plug body 7 by reason of the relative helical movement of the ring 3 in relation to the said plug body. At the end of the 90° rotation of the ring, the projections with straight or crenellated sides 26 become housed in the notches 21, resulting in locking of the ring 3 on the plug body 7, this latter being in the open position, that is to say the position of maximum retraction within the ring 3.

In the example illustrated, the notches 21 and the crenellations 26 are shown as having straight sides. However, if it is deemed adequate, these notches and crenellations could be provided with sloping sides permitting of easier unlocking, considering the compression of the spring 20, when this unlocking is order to the socket body 4.

In the same way, it is stated in the present description that the member 17 is mounted on the ring 3, while the collar 25 is mounted on the plug body 7. However, the construction may be the other way round, the collar 25 being movably mounted on the ring 3 while the member 17 could be made by a machining of the member 12 or of the plug body 7.

I claim:

1. Multi-pin electrical connector, comprising a socket having a socket body containing a block of electrically insulative material and a plug having a plug body containing a block of electrically insulative material, one of said socket and plug being provided with female pins and the other thereof being provided with male pins, a ring rotatably mounted on said plug body for ensuring relative axial displacement between the ring and plug body when when the ring rotates on the plug body, said ring and said socket body each including ribs arranged for interfitting with one another while permitting rotation of the ring on the socket body, locking means for angularly positioning said ring relative to said plug, in the position where the ring is farthest forward the end of the plug, said locking means being disposed between said ring and said plug body for unlocking by an axial movement relative to the socket body, said socket body being located outside of the plug body and between said ring and said plug body, said socket body having a length such that, when the socket and plug are assembled the socket body acts on the locking means to effect unlocking thereof.

2. The connector according the claim 1 wherein said locking means is located on said plug body and said ring and wherein the locking means includes at least one straight-sided rib and at least one correspondingly shaped straight rib housing orientated axially on said plug, and one of said straight-sided ribs and said straight rib housing being formed on a member movable axially on said plug.

3. The connector according to claim 2, wherein said member movable axially on said plug includes a one end thereof said at least one straight-sided rib housing and at the opposite end thereof at least one oblique-sided rib, the distance between the straight-sided rib housing and said oblique-sided rib corresponding to the relative axial travel of the plug body on the ring upon rotation of this latter.

4. The conector according to claim 3, further including a washer including one of said oblique-sided rib and an oblique sided housing for movement on said movable member, and a spring against which said movable member can move.

5. The connector according to claim 3 further including a spring against which said movable member is adapted for movement.

6. The connector according to claim 3, wherein said movable member moves along an inner wall of said ring, and wherein said movable member includes a cylindrical member having inner returned edges at its lower and upper ends, said returned edges being provided with locking rib or notches, a collar on said plug body having locking ribs or notches complementary to the notches or ribs of the returned edges and disposed for movement between the upper and lower returned edges.

7. The connector according to claim 1 wherein said socket body and said plug body include complementary non-confusible ribs formed on the inside face of the socket body and on the outside face of the plug body.

8. The connector according to claim 7 wherein said ribs on said ring and said socket body, are made in an axial direction, of such a height that the non-confusible ribs cooperate with one another before the ribs penetrate one into the other.

* * * * *